US005833488A

United States Patent [19]

Roy et al.

[11] Patent Number: 5,833,488

[45] Date of Patent: Nov. 10, 1998

[54] BLADED WIRE CONNECTOR AND METHOD FOR FORMING SAME

[75] Inventors: Dhirendra C. Roy, Plymouth; Richard J. Chutorash, Rochester Hills, both of Mich.

[73] Assignee: UT Automotive Dearborn, Inc., Dearborn, Mich.

[21] Appl. No.: 770,102

[22] Filed: Dec. 19, 1996

[51] Int. Cl.[6] ..... H01R 4/24

[52] U.S. Cl. ..... 439/423; 439/424

[58] Field of Search ..... 439/421, 422, 439/423, 424

[56] References Cited

U.S. PATENT DOCUMENTS

| | | | |
|---|---|---|---|
| 3,715,705 | 2/1973 | Kuo | 439/422 |
| 3,758,703 | 9/1973 | Golden et al. | 439/423 |
| 3,767,841 | 10/1973 | Anderson et al. | 439/423 |
| 3,798,347 | 3/1974 | Harding et al. | 439/423 |
| 3,950,064 | 4/1976 | Kuo | 439/421 |
| 3,989,339 | 11/1976 | Haitmanek | 439/421 |
| 4,749,368 | 6/1988 | Mouissie | 439/421 |
| 5,484,305 | 1/1996 | Diniz et al. | 439/421 |

*Primary Examiner*—Gary F. Paumen
*Assistant Examiner*—Tho Dac Ta
*Attorney, Agent, or Firm*—Howard & Howard

[57] ABSTRACT

A connector is provided having a set of spaced blades that cooperate to penetrate the coating of a wire to make electrical contact with the wire while the connector is bent therearound. The blades are disposed circumferentially about the wire at approximately 120° intervals. The connector may have a plurality of sets of blades. Further, a method of forming a connection between a wire having a coating and a connector is disclosed having the steps of extending a first, a second and a third blade from a connector body, the second blade disposed between the first and third blades, and bending the body about a portion between the first and second blades and about a portion between the second and third blades so that the blades engage the wire through the coating.

12 Claims, 3 Drawing Sheets

BLADED WIRE CONNECTOR AND METHOD FOR FORMING SAME

TECHNICAL FIELD

This invention relates to a method and apparatus relating to wire connectors and more particularly to a wiring connector having blades that effectuate a connection with a coated wire.

BACKGROUND ART

As is well known in the art, wires must be connected at their ends to other wires or electrical devices. Typically, coated wires are stripped of their insulation to make electrical connections with connectors. The connector is then electrically connect to another connector, an electrical component or another wire. However, stripping the wire is time consuming and may cause defects if the wire is damaged during the stripping process.

DISCLOSURE OF THE INVENTION

It is an object of the invention to create a connector that electrically connects with a coated wire with a minimum of time and effort.

It is a further object of the invention to create a connector that, while being formed, securely engages a wire.

It is a still further object of the invention to electrically connect with a coated wire without stripping the wire.

According to the invention, a connector is provided having a set of spaced bladed surfaces that cooperate to penetrate the coating of a wire to make electrical contact with the wire while the connector is bent therearound. According to a feature of the invention, the blades are circumferentially located about the wire at approximately 120° intervals. According to a further feature of the invention, the connector has a plurality of sets of blades.

Further according to the invention, a method of forming a connection between a wire having a coating and a connector is disclosed having the steps of extending a first, a second and a third blade from a connector body, the second blade disposed between the first and third blades, and bending the body about a portion between the first and second blades and about a portion between the second and third blades so that the blades engage the wire through the coating.

These and other features of the present invention can be best understood from the following specification and drawings, of which the following is a brief description.

DESCRIPTION OF THE PREFERRED EMBODIMENT

Figure 1:
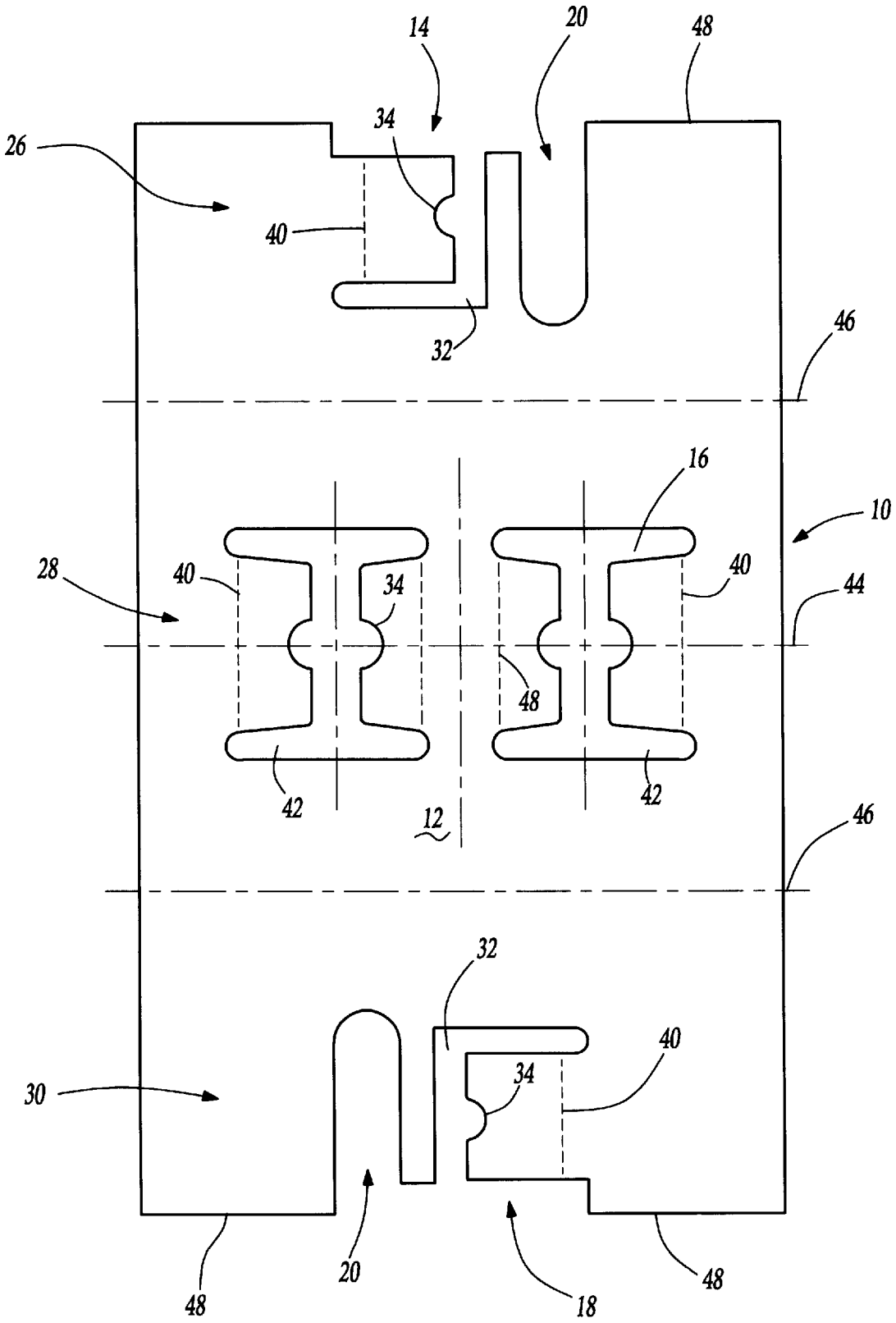
FIG. 1 is a plan view of the connector of the invention.

FIG. 1 shows a plan view of the connector 10 of the invention. The connector has: a body 12; three sets of blades protruding therefrom, a first end blade 14, a middle set of blades 16 and a second end blade 18; and a plurality of U-shaped cut-outs 20 for receiving the end blades 14, 18, as will be discussed infra. According to a further feature of the invention the connector may have a tab 22 and slot 24 (see FIG. 5) that minimize spring-back after the connector is formed as will be discussed infra.

Figure 4:
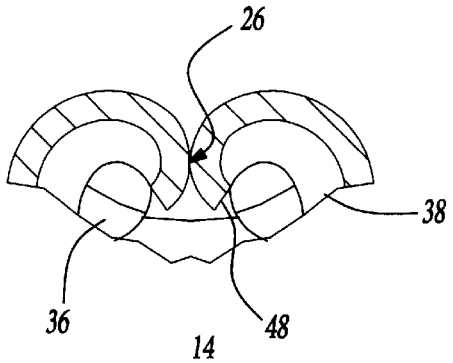
FIG. 4 is a view showing edges of the connector penetrating the coating and engaging a wire.

The connector body 12 is an electrically conductive, flat, rectangular, bendable blank material as is known in the art. The body has a first end portion 26, a central portion 28, and a second end portion 30. The first and second end portions each have an M-shaped cutout 32. The M-shaped cutouts 32 define the first and second end blades 14, 18, each blade having a central arc 34 for gripping a wire strand (s) 36 and penetrating its coating 38 as will be discussed infra. The U-shaped cut-outs 20 define openings that receive a blade 14 or 18 from the other end portion as will be discussed infra. The central portion 28 has a pair of H-shaped cutouts 42 that define the middle set of blades 16, each blade having a central arc 34 for gripping a wire as will be discussed infra. A first axis 44 passes along the central arc in the middle set of blades. A second axis 46 extends between each end portion and the central portion. Each end portion has a coined edge 48 to allow the connector to grip the wire after penetrating the coating if the connector is crimped (see FIG. 4).

Figure 2:
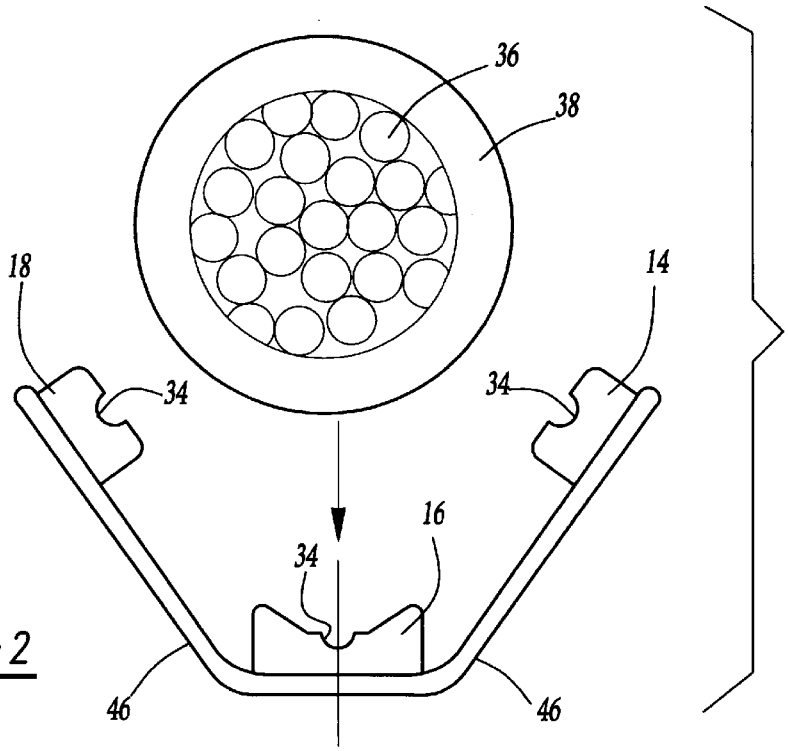
FIG. 2 is a transverse view of the connector of FIG. 1 showing blades in position to engage a wire.
Figure 3:
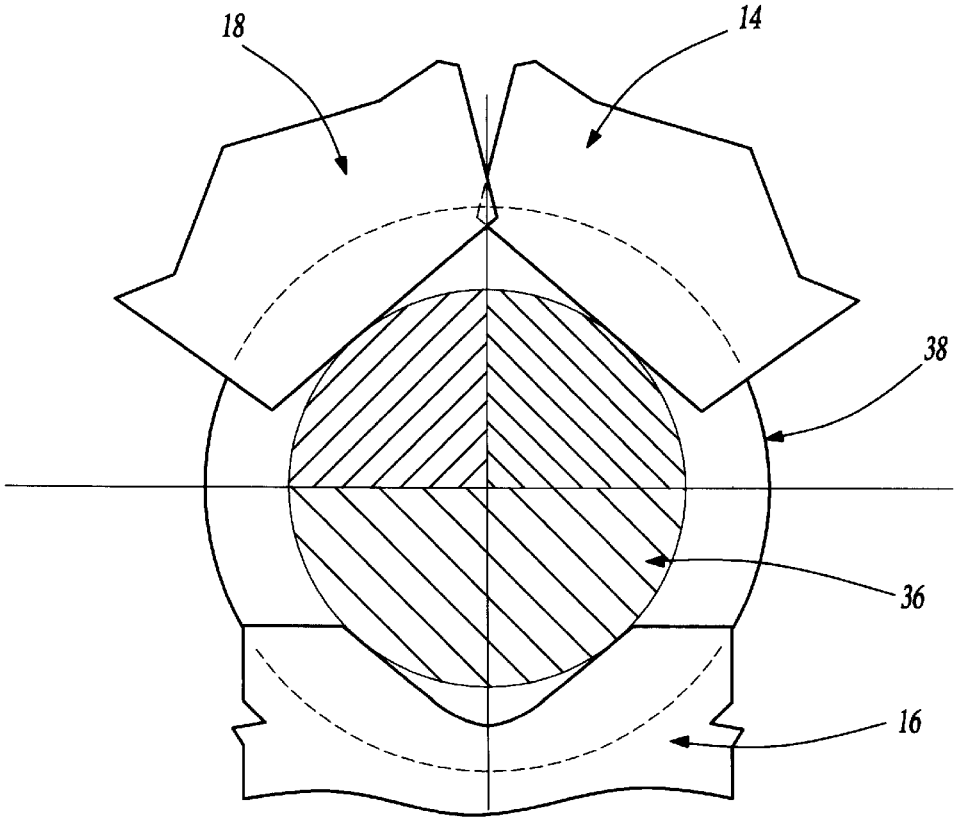
FIG. 3 is a cutaway view of the connector of FIG. 1 showing blades engaging a wire.

To attach the connector 10 to a strand(s) 36, the blades are bent 90° along lines 40 in the same direction as the other blades (e.g., either into or out of the page). The strand is disposed along axis and nests within the central arcs 34. The body is then bent in two sections along second axes 46 (see FIG. 2) thereby driving the blades through the wire coating 38 into contact with the strand(s) 36 (see FIG. 3). Because the end blades 14, 18 are offset from the middle set 16, the blades do not interfere with each other while gripping the wire. The offset also minimizes the probability that the wire is stripped if the wire and the connector are subjected to a certain pulling force, i.e., the blades do not cut the wire coating around the circumference of the wire in one location. Because the end blades are received within the U-shaped cutouts 40 on each other end portion of the body, the body also does not interfere with the blades contacting the wire. The blades engage the wire in several sections at approximately 120° intervals to ensure electrical connection with the wire and to make it difficult to disconnect the wire from the connector. To further ensure electrical or mechanical connection with the wire, the coined edges 48 are crimped through the wire coating into contact with the wire, thereby completing construction of the connection (see FIG. 4).

Figure 5:
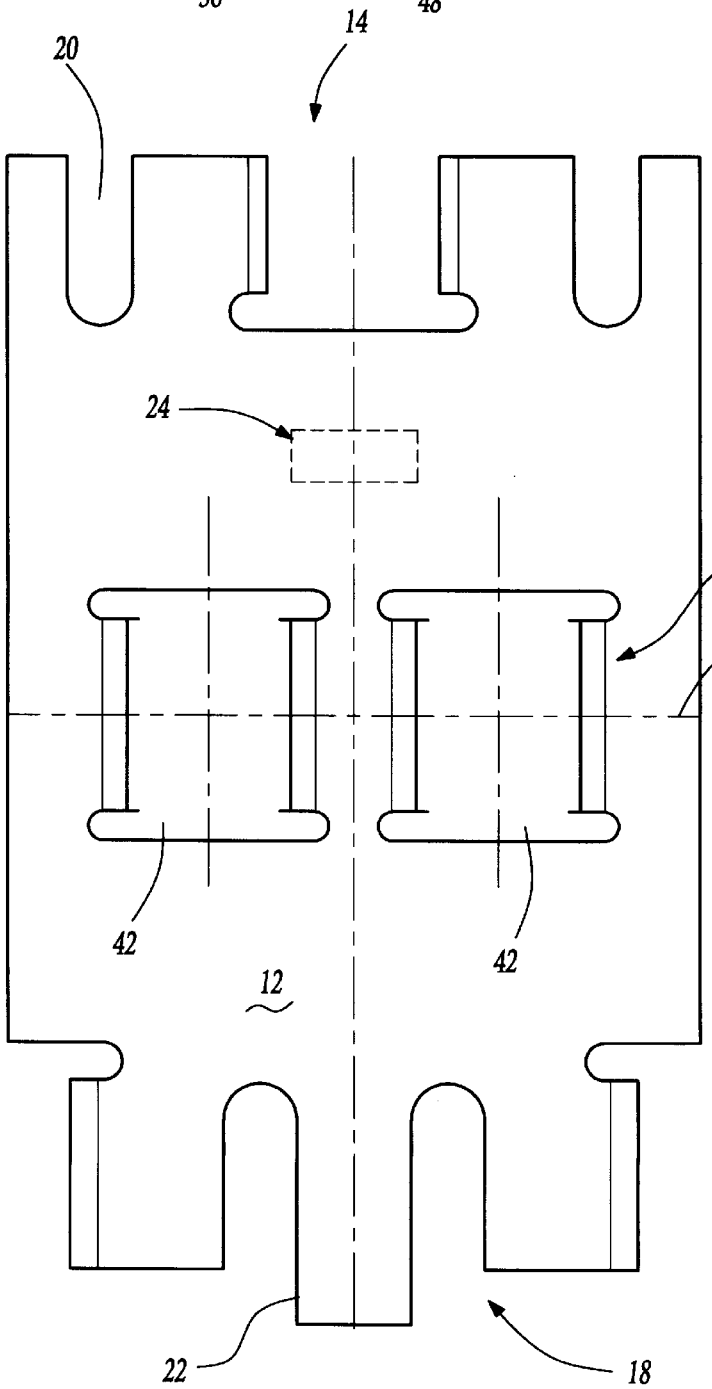
FIG. 5 is a further embodiment of the connector of the invention.

According to an embodiment of the invention as shown in FIG. 5, the body may have a tab 22 disposed at one end thereof. The tab 22 is inserted into slot 24 if the body is bent to minimize the possibility that the connector springs away from the wire. As further provided in FIG. 5, the body has two blades in each end set of blades and two sets of U-shaped cut-outs to receive each blade if the body is bent to maximize contact with a wire.

The present invention has several advantages. By utilizing blades to contact the wire, stripping is eliminated and production efficiencies are realized without damaging the wire. By utilizing a plurality of offset blades, the wire is gripped securely minimizing the risk of stripping the coating from the wire. By providing a locking tab, spring back after crimping is minimized.

Although the invention has been shown and described with respect to a best mode embodiment thereof, it should be understood by those skilled in the art that the foregoing and various other changes, omissions, and addition in the form and detail thereof maybe be made therein without departing from the spirit and scope of the invention. For instance, the number of blades at the middle portion or either end of the body may vary depending on the amount of grip strength and electrical contact required.

We claim:

1. An electrical connector for attaching to a conductive wire having a coating, comprising:

a bendable body extending between two lateral sides, said lateral sides being bent towards each other relative to a central portion of said body, said lateral sides being bent about a first axis, said two lateral sides and said central portion each including blades for engaging a wire; and said body being formed with cut portions, and said blades being defined at edges of said cut portions and then being bent away from a plane of said body, said blades being bent about a second axis, such that said blades are each formed at an edge of said body wherein said first axis is substantially perpendicular to said second axis and bent away from said plane of said body.

2. An electrical connector as recited in claim 1, wherein said blades at said lateral sides incorporate a slot formed laterally inwardly of said blade and extending beyond said edge to facilitate bending of said blade.

3. An electrical connector as recited in claim 1, wherein each of said lateral sides of said body having cut-out portions for allowing passage of said blade associated with the other lateral side of said body when said body is secured to a wire.

4. An electrical connector as recited in claim 3, wherein said body further having a longitudinal dimension perpendicular to a lateral dimension, and said blade on one lateral side of said body being spaced towards a first longitudinal end of said body from its associated cut-out, and said blade on an opposed lateral side having its cut-out portion spaced toward said first longitudinal end relative to its blade portion.

5. An electrical connector as recited in claim 3, wherein each lateral side having two sets of cut-outs and blades.

6. An electrical connector as recited in claim 1, wherein there are a plurality of blades associated with said central portion said blades being bent from an edge portion.

7. An electrical connector as recited in claim 6, wherein there are at least four of said blades associated with said central portion, there being two cut portions with two of said blades being associated with each of said cut portions.

8. An electrical connector for attaching to a conductive wire having a coating, comprising:

a bendable body having longitudinally spaced ends and laterally spaced sides, said bendable body having its laterally spaced sides being bent towards each other to be positioned about a wire, said lateral spaced sides being bent about a first axis;

blades being defined for engaging a wire when said body is bent around a wire, there being at least one blade associated with each of said laterally spaced side, and a plurality of blades formed in a central portion between said laterally spaced sides, each of said blades being formed by cut portions formed in to said body prior to said laterally spaced ends being bent, such that said blades are bent away from a planar portion of said body, and define an edge of said body adjacent said cut portions said blades being bent about a second axis, and wherein said first axis substantially perpendicular to said second axis.

9. An electrical connector as recited in claim 8, wherein each lateral side having two sets of cut-outs and blades.

10. An electrical connector as recited in claim 8, wherein said blades at said lateral sides incorporate a slot formed laterally inwardly of said blade and extending beyond said edge to facilitate bending of said blade.

11. An electrical connector as recited in claim 8, wherein each of said lateral sides of said body having cut-out portions for allowing passage of said blade associated with the other lateral side of said body when said body is secured to a wire.

12. An electrical connector as recited in claim 11, wherein said body further having a longitudinal dimension perpendicular to a lateral dimension, and said blade on one lateral side of said body being spaced towards a first longitudinal end of said body from its associated cut-out, and said blade on an opposed lateral side having its cut-out portion spaced toward said first longitudinal end relative to its blade portion.

* * * * *